US006875159B2

(12) United States Patent
Chuang

(10) Patent No.: US 6,875,159 B2
(45) Date of Patent: Apr. 5, 2005

(54) TWIST EXERCISER HAVING PIVOTAL FOOT SUPPORTS

(76) Inventor: Jin Chen Chuang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/647,876

(22) Filed: Aug. 21, 2003

(65) Prior Publication Data

US 2005/0043143 A1 Feb. 24, 2005

(51) Int. Cl.[7] ..... A63B 71/00
(52) U.S. Cl. ..... 482/51; 482/146
(58) Field of Search ..... 482/79, 115, 123, 482/127, 70, 146–148, 51

(56) References Cited

U.S. PATENT DOCUMENTS

| | | | | | |
|---|---|---|---|---|---|
| 3,441,271 | A | * | 4/1969 | Palacios | 482/146 |
| 3,612,519 | A | * | 10/1971 | Larson | 482/147 |
| 3,911,907 | A | * | 10/1975 | Smith, Jr. | 482/1 |
| 4,390,180 | A | | 6/1983 | Simjian | 272/126 |
| 4,391,441 | A | | 7/1983 | Simjian | 272/126 |
| 5,078,389 | A | | 1/1992 | Chen | 272/70 |
| 5,242,340 | A | | 9/1993 | Jerome | 482/52 |
| 5,407,408 | A | | 4/1995 | Wilkinson | 482/54 |
| 5,433,690 | A | | 7/1995 | Gilman | 482/146 |
| 5,599,262 | A | * | 2/1997 | Shih | 482/147 |
| 5,632,711 | A | * | 5/1997 | Hwang | 482/147 |
| 5,695,439 | A | * | 12/1997 | Lin | 482/146 |
| 5,888,182 | A | * | 3/1999 | Shih | 482/147 |
| 6,280,368 | B1 | * | 8/2001 | Liao | 482/146 |

* cited by examiner

*Primary Examiner*—Justine R. Yu
*Assistant Examiner*—Tam Nguyen
(74) *Attorney, Agent, or Firm*—Charles E. Baxley

(57) ABSTRACT

A twist exerciser includes a platform rotatably supported on a base, and one or more rotary members rotatably supported in the platform to selectively support feet of users, and to allow the feet of the users to be rotated relative to the platform when the platform is rotated relative to the base. The rotary member may be rotatably supported on a seat of the platform with a pivot pin, and the platform may include a cover having one or more openings to receive the rotary members. One or more belts may apply a resistive force against the platform. A handle may be rotatably supported on the base and coupled to the platform.

9 Claims, 4 Drawing Sheets

TWIST EXERCISER HAVING PIVOTAL FOOT SUPPORTS

BACKGROUND OF THE INVENTION

1. Field of the Invention

The present invention relates to a twist exerciser, and more particularly to a twist exerciser having rotatable or pivotal foot pedals or foot supports to comfortably support the users on the twist exercisers.

2. Description of the Prior Art

Various kinds of typical twist exercisers have been developed and comprise a rotatable platform rotatably supported on a base, to support users thereon, and to allow the users to twist their bodies or their waist portions.

For example, U.S. Pat. No. 5,078,389 to Chen, and U.S. Pat. No. 5,407,408 to Wilkinson disclose two of the typical twist exercisers having a rotatable platform for rotatably supporting the users thereon. However, the legs of the users may not be rotated relative to the rotatable platform and may thus have a good chance to be twisted or hurt during the twisting operations or exercises.

U.S. Pat. No. 5,242,340 to Jerome discloses another typical twist exerciser having a pair of foot rests disposed on a rotatable table for supporting the users thereon. However, the legs of the users also may not be rotated relative to the rotatable table and may thus have a good chance to be twisted or hurt during the twisting operations or exercises.

U.S. Pat. No. 4,390,180 to Simjian, U.S. Pat. No. 4,391,441 to Simjian, and U.S. Pat. No. 5,433,690 to Gilman discloses three other typical twist exercisers each also having a rotatable platform for supporting the users thereon, and each further having a handle coupled to the rotatable platform, to rotate or drive the rotatable platform with the handle. However, similarly, the legs of the users also may not be rotated relative to the rotatable platform and may thus have a good chance to be twisted or hurt during the twisting operations or exercises.

The present invention has arisen to mitigate and/or obviate the afore-described disadvantages of the conventional twist exercising devices.

SUMMARY OF THE INVENTION

The primary objective of the present invention is to provide a twist exerciser including a pair of rotatable or pivotal foot pedals or foot supports to comfortably support the users on the twist exercisers.

In accordance with one aspect of the invention, there is provided a twist exerciser comprising a base, a platform rotatably supported on the base, and at least one rotary member rotatably supported in the platform to selectively support feet of users, and to allow the feet of the users to be rotated relative to the platform when the platform is rotated relative to the base.

The rotary member includes a pad disposed thereon to comfortably support the feet of the users. The platform includes a seat, the rotary member is rotatably supported on the seat of the platform with a pivot pin. The platform includes a cover disposed on the seat, the cover includes at least one opening formed therein to receive the rotary member.

A resistive force applying may further be provided for applying a resistive force against the platform, and may include a barrel extended from the platform, and at least one belt engaged around the barrel to apply the resistive force against the barrel of the platform.

A fastener may further be provided and coupled to the belt, to adjust the resistive force of the belt applied onto the barrel of the platform.

A handle may further be provided and supported on the base. For example, the handle may be rotatably secured on the base with an axle. A coupling device may further be provided for coupling the handle and the platform together, and may include a first follower member attached to the handle, a second follower member attached to the platform, and at least one cable coupled around the first and the second follower member, to couple the handle and the platform together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
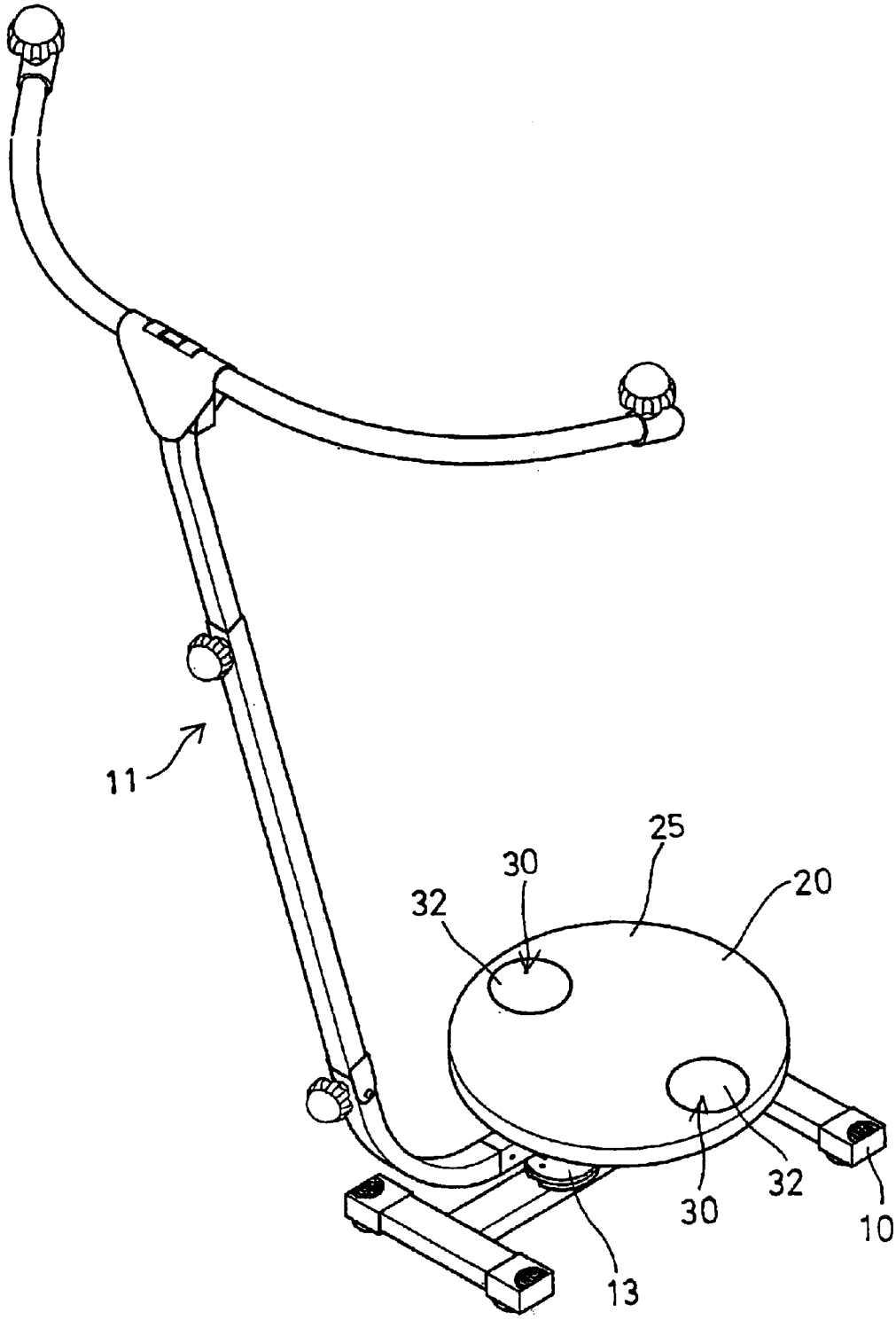
FIG. 1 is a perspective view of a twist exerciser in accordance with the present invention.

Referring to the drawings, and initially to FIGS. 1–4, a twist exerciser in accordance with the present invention comprises a base 10 including an axle 12 and a shaft 14 and a beam 15 extended upwardly therefrom, a handle 11, such as a retractable or adjustable handle 11 including a lower portion pivotally or rotatably secured to the base 10 with the axle 12, to allow the handle 11 to be rotated with or relative to the axle 12 of the base 10.

A platform 20 includes a seat 21 pivotally or rotatably secured to the base 10 with the shaft 14, to allow the seat 21 of the platform 20 to be rotated with or relative to the shaft 14 of the base 10. For example, the platform 20 may include a barrel 22 extended downwardly from the seat 21, and pivotally or rotatably engaged onto the shaft 14 of the base 10, in order to pivotally or rotatably secure the platform 20 to the base 10.

A follower member 13, such as a pulley 13 is secured to the handle 11 and rotated in concert with the handle 11. Another follower member 23, such as a pulley 23 is secured to the platform 20 and rotated in concert with the platform 20. One or more wires or cables 24 are engaged around the pulleys 13, 23, and coupled to the handle 11 and the platform 20 respectively, to rotatably couple the handle and the platform 20 together.

Figure 5:
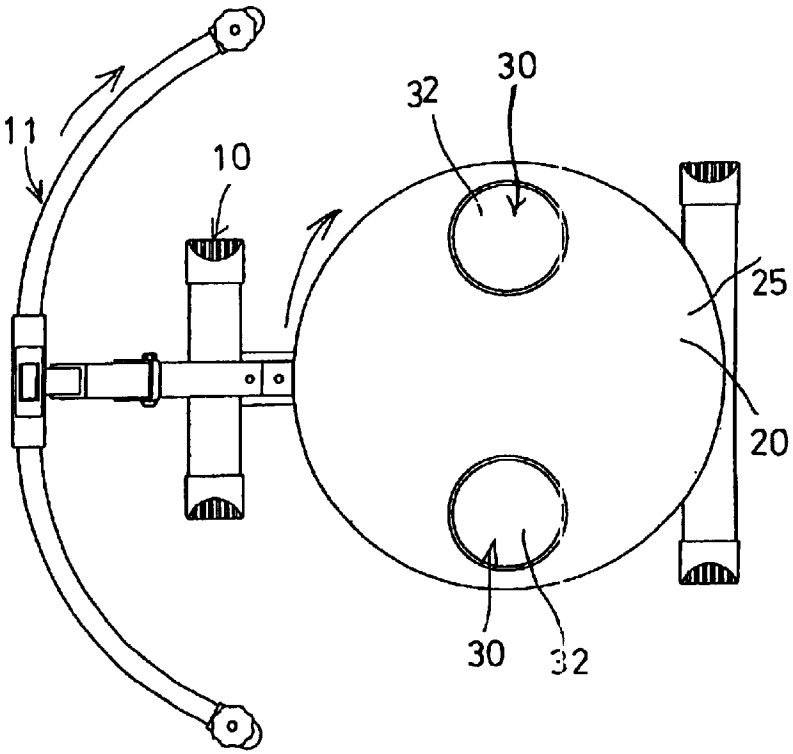
FIG. 5 is a top plan view of the twist exerciser, similar to FIG. 3, illustrating the other arrangement of the twist exerciser.
Figure 4:
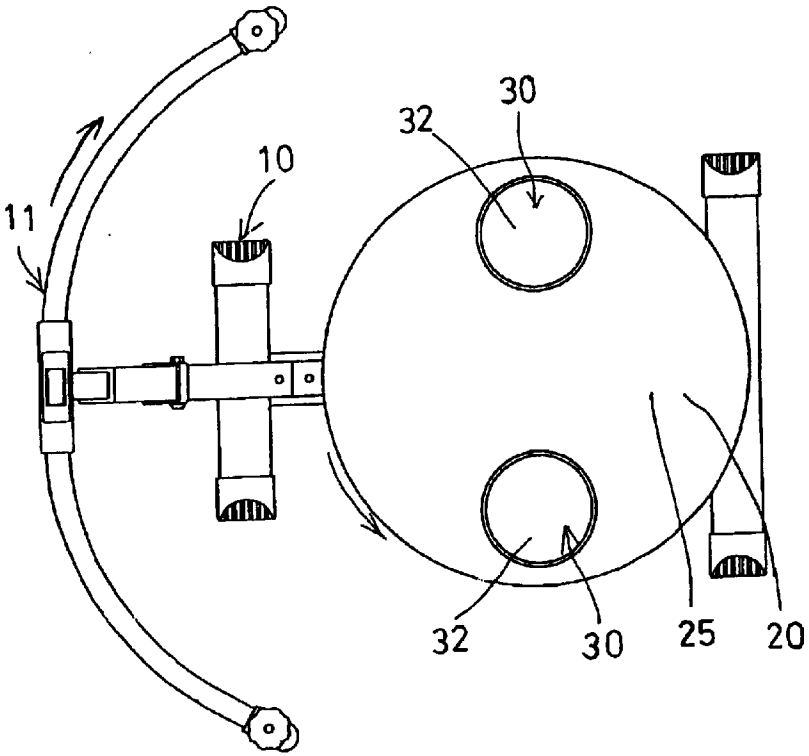
FIG. 4 is a top plan view of the twist exerciser.

In operation, the platform 20 may be rotated by the handle 11 via the pulleys 13, 23 and the cables 24, or the handle 11 may be rotated by the platform 20 via the pulleys 13, 23 and the cables 24 (FIGS. 4, 5). In addition, the cables 24 may be arranged and coupled around the pulleys 13, 23 in different directions to allow the platform 20 to be rotated by the handle 11 in different direction (FIG. 4), or in the same direction (FIG. 5).

The examples of the coupling between the pulleys 13, 23 and the cables 24 have been disclosed in the cited U.S. Pat.

No. 4,390,180 to Simjian, U.S. Pat. No. 4,391,441 to Simjian, and U.S. Pat. No. 5,433,690 to Gilman, which may be taken as references for the present invention.

The platform 20 may further include a pad or cover 25 engaged or secured onto the seat 21, and to be pivotal or rotatable in concert with the seat 21 relative to the base 10. The platform 20 may further include one or more rotary members 30 rotatably secured thereon with pivot pins 31 and/or bearings (not shown). For example, the rotary members 30 may be rotatably secured on the seat 21 with the pivot pins 31.

Each of the rotary members 30 may further include a pad 32 disposed or secured thereon for comfortably support the feet of the users thereon. The cover 25 of the platform 20 may further include one or more openings 27 formed therein to rotatably receive the rotary members 30 therein. The rotary members 30 or the pads 32 of the rotary members 30 preferably include an upper surface flush with the platform 20 or extendible upwardly and slightly beyond the upper surface of the cover 25 or of the platform 20.

Figure 2:
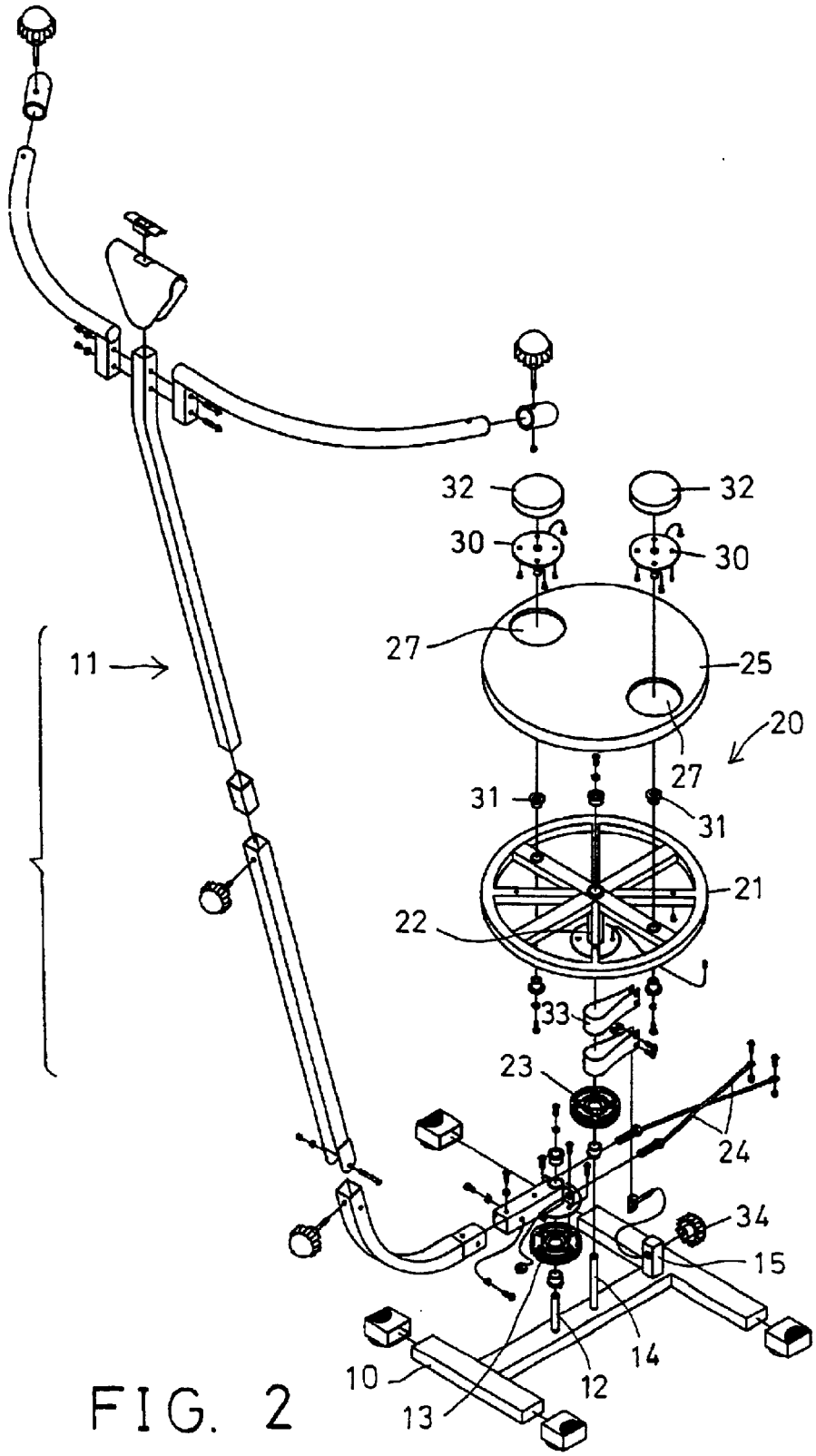
FIG. 2 is an exploded view of the twist exerciser.
Figure 3:
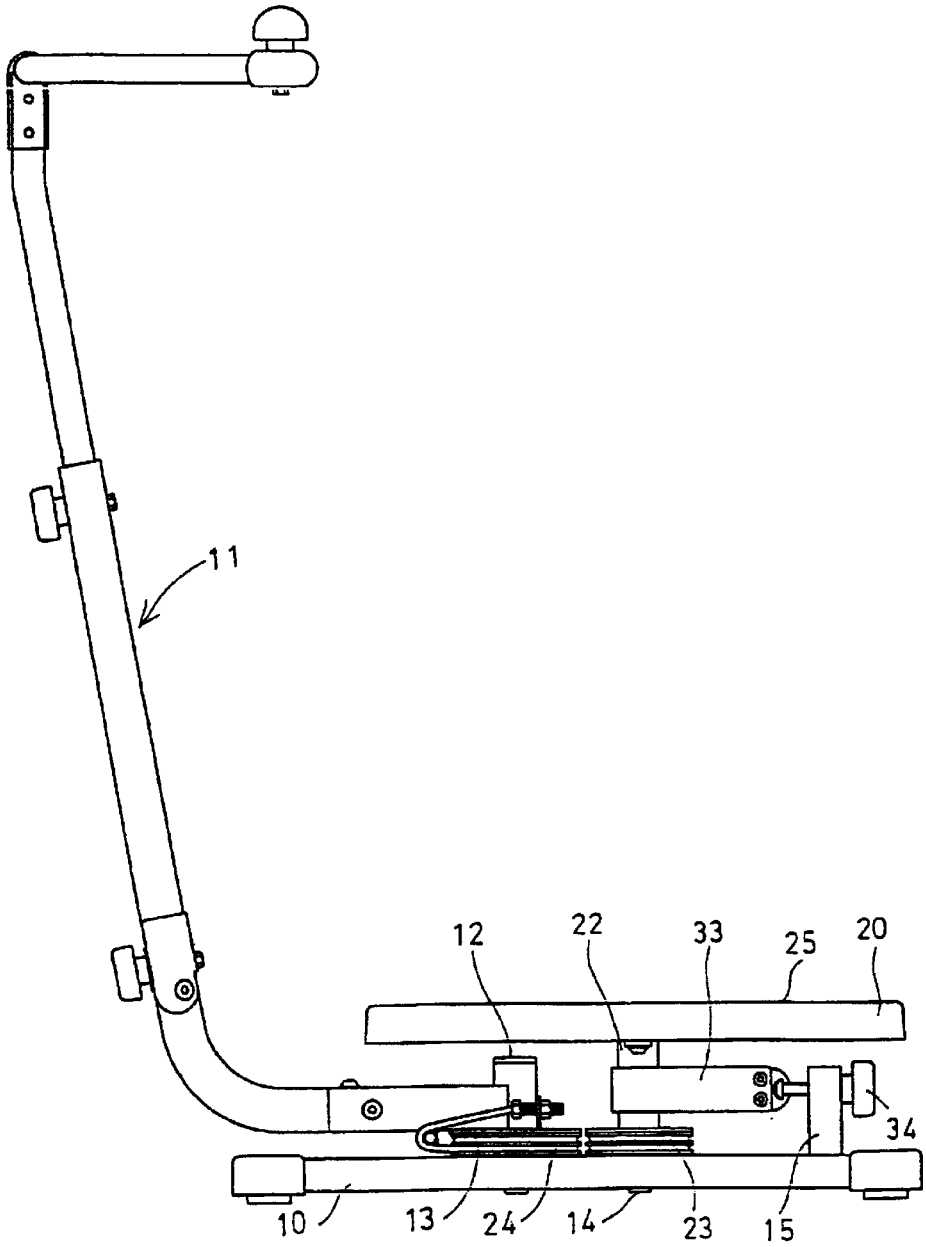
FIG. 3 is a side plan view of the twist exerciser.

As shown in FIGS. 2–3, one or more straps or belts 33 may further be provided and engaged around the barrel 22, and a fastener 34 may be engaged through the beam 15 of the base 10 and coupled to the belts 33, in order to adjust the resistive or frictional force of the belts 33 applied onto the barrel 22, and thus to apply or to adjust the resistive force applied to the platform 20 and thus to the handle 11.

In operation, the users may have their feet stepped onto the platform 20, to rotate the platform 20 and/or to rotate the handle 11, in order to conduct the twisting exercises. Alternatively, the users may selectively have either or both of their feet stepped onto the rotary members 30, or may selectively have their feet stepped onto the rotary members 30 respectively, to prevent the feet of the users from rotating together with the platform 20, due to the freely and rotatable engagement of the rotary members 30 in or on the platform 20.

Accordingly, the twist exerciser in accordance with the present invention includes a pair of rotatable or pivotal foot pedals or foot supports to comfortably support the users on the twist exercisers, and for preventing the users' legs from being twisted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A twist exerciser comprising:

a base, a platform rotatably supported on said base, at least one rotary member rotatably supported in said platform to selectively support feet of users, and to allow the feet of the users to be rotated relative to said platform when said platform is rotated relative to said base, and means for applying a resistive force against said platform, said resistive force applying means including a barrel extended from said platform, and at least one belt engaged around said barrel to apply the resistive force against said barrel of said platform.

2. The twist exerciser as claimed in claim 1, wherein said at least one rotary member includes a pad disposed thereon to comfortably support the feet of the users.

3. The twist exerciser as claimed in claim 1, wherein said platform includes a seat, said at least one rotary member is rotatably supported on said seat of said platform with a pivot pin.

4. The twist exerciser as claimed in claim 3, wherein said platform includes a cover disposed on said seat, said cover includes at least one opening formed therein to receive said at least one rotary member.

5. The twist exerciser as claimed in claim 1, wherein said resistive force applying means includes a fastener coupled to said at least one belt, to adjust the resistive force of said at least one belt applied onto said barrel of said platform.

6. The twist exerciser as claimed in claim 1 further comprising a handle supported on said base.

7. The twist exerciser as claimed in claim 6, wherein said handle is rotatably secured on said base with an axle.

8. The twist exerciser as claimed in claim 7 further comprising means for coupling said handle and said platform together.

9. The twist exerciser as claimed in claim 8, wherein said coupling means includes a first follower member attached to said handle, a second follower member attached to said platform, and at least one cable coupled around said first and said second follower member, to couple said handle and said platform together.

* * * * *